US012247465B2

(12) United States Patent
Aldossary et al.

(10) Patent No.: US 12,247,465 B2
(45) Date of Patent: Mar. 11, 2025

(54) METHOD AND APPARATUS FOR CURING LOSS-OF-CIRCULATION IN OIL AND GAS WELLS WITH A EUTECTIC ALLOY EXPANDABLE PATCH

(71) Applicant: SAUDI ARABIAN OIL COMPANY, Dhahran (SA)

(72) Inventors: Saeed Abdullah Aldossary, Khobar (SA); Amjad Alshaarawi, Khobar (SA); Abdulwahab Aljohar, Dhahran (SA); Meshari M. Alshalan, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/326,058

(22) Filed: May 31, 2023

(65) Prior Publication Data

US 2024/0401440 A1 Dec. 5, 2024

(51) Int. Cl.
*E21B 43/10* (2006.01)
*E21B 33/13* (2006.01)
*E21B 36/04* (2006.01)

(52) U.S. Cl.
CPC ..... *E21B 43/105* (2013.01); *E21B 33/13* (2013.01); *E21B 36/04* (2013.01)

(58) Field of Classification Search
CPC ..... E21B 43/105; E21B 33/13; E21B 36/04
See application file for complete search history.

(56) References Cited

U.S. PATENT DOCUMENTS

| | | | | |
|---|---|---|---|---|
| 3,162,245 | A * | 12/1964 | Fast | E21B 43/105 166/207 |
| 10,550,663 | B2 | 2/2020 | Doherty | |
| 11,085,265 | B2 | 8/2021 | Rivas Diaz | |
| 11,098,553 | B2 | 8/2021 | Benzie et al. | |
| 11,365,611 | B2 | 6/2022 | Gibb | |
| 2005/0045324 | A1* | 3/2005 | Cook | E21B 33/047 264/269 |
| 2005/0230115 | A1* | 10/2005 | Rose | E21B 17/026 166/301 |
| 2012/0037381 | A1* | 2/2012 | Giroux | E21B 23/01 166/217 |

(Continued)

OTHER PUBLICATIONS

Nediljka Gaurina-Medimurec and Pavao Mesari?, "Application of Solid Exandable Tubulars in the Petroleum Industry," The Mining-Geology-Petroleum Engineering Bulletin, Jan. 2022, 19 pages.

*Primary Examiner* — Tara Schimpf
*Assistant Examiner* — Jennifer A Railey
(74) *Attorney, Agent, or Firm* — Osha Bergman Watanabe & Burton LLP

(57) ABSTRACT

A downhole tool is disclosed that includes an expandable liner, an expansion cone, and an expansion cone driver connected to the expansion cone. The expandable liner includes an upper tubular body, a lower cone housing having an outer diameter greater than the upper tubular body, a eutectic alloy layer surrounding a circumference of the upper tubular body, and a bottom packer and a top packer extending around the upper tubular body and positioned around opposite ends of the eutectic alloy layer. The expansion cone has a cone body provided in the lower cone housing and a heater provided around an outer surface of the cone body.

17 Claims, 6 Drawing Sheets

(56) References Cited

U.S. PATENT DOCUMENTS

| | | | | |
|---|---|---|---|---|
| 2020/0056444 | A1* | 2/2020 | Benzie | E21B 33/1204 |
| 2020/0332620 | A1* | 10/2020 | Carragher | E21B 33/13 |
| 2021/0115750 | A1 | 4/2021 | Fripp et al. | |
| 2022/0018201 | A1 | 1/2022 | Bouldin et al. | |

* cited by examiner

METHOD AND APPARATUS FOR CURING LOSS-OF-CIRCULATION IN OIL AND GAS WELLS WITH A EUTECTIC ALLOY EXPANDABLE PATCH

BACKGROUND

In oil or gas well drilling, lost circulation or loss-of-circulation occurs when drilling fluid, known commonly as "mud," flows into one or more geological formations instead of returning up the annulus. Lost circulation can be a serious problem during the drilling of an oil well or gas well. For example, total lost returns may lead to reduction of the fluid column in the well and pressure exerted on the open formation. As a result, this might lead to a catastrophic loss of well control.

Lost circulation events may occur due to natural or induced fractures. Natural causes include encounters with naturally fractured or unconsolidated formations. Induced losses occur when the hydrostatic fluid pressure (the pressure exerted by the drilling mud on the walls of the well) exceeds the fracture gradient of the formation (the maximum pressure after which the formation breaks) and the formation pores breakdown enough to receive rather than resist the fluid. When lost circulation occurs, forward progress on well delivery is generally setback, and can often provoke new requirements of time, drilling fluids, and cement, and add substantially to the overall cost and time of a well.

The drilling industry has developed several techniques to fight losses, including, for example, the use of lost-circulation materials (LCM) to plug fractures, the use of chemicals, and the use of cement. Chemical methods and cementing are used in day-to-day drilling activities, but they are insufficient in some scenarios, especially in the case of total loss-of-circulation. In particular, as LCM or cement flows in the liquid phase to the loss zone, they end up drifting away deep into the fractures long before they solidify.

Another solution has been the use of metal expandable liners. With such technology, a solid metal liner is run-in-hole across the loss zone. This liner is then expanded against the walls of the well in order to seal the loss zone. In particular, these liners are expanded by pulling a cone with larger diameter through them. As the cone is pulled, the inner diameter of the liner expands to fit the cone. However, if any cuttings/formation breakage falls behind the expandable liner, the expansion process might fail. Additionally, there is a risk of drilling fluid continuing to leak from above and below the expandable liner. To resolve such issues, two additional packers may be installed at the top and bottom of the expandable liner in order to create a tight seal through which fluid flow is prevented. However, the use of packers is not guaranteed to work because the diameter of the well is typically irregular and larger than the used bit size due to wash outs, which makes it hard to ensure that the packers seal properly.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a downhole tool that includes an expandable liner, an expansion cone, and an expansion cone driver connected to the expansion cone. The expandable liner includes an upper tubular body, a lower cone housing having an outer diameter greater than the upper tubular body, a eutectic alloy layer surrounding a circumference of the upper tubular body, and a bottom packer and a top packer extending around the upper tubular body and positioned around opposite ends of the eutectic alloy layer. The expansion cone has a cone body provided in the lower cone housing and a heater provided around an outer surface of the cone body.

In another aspect, embodiments disclosed herein relate to systems that include a pipe string extending through a well from wellhead equipment at an opening to the well, an expansion cone driver connected at an end of the pipe string, an expansion cone connected at an end of the expansion cone driver, and a eutectic expandable liner positioned around the expansion cone. The eutectic expandable liner may include an upper tubular body, a lower cone housing having an outer diameter greater than the upper tubular body, a eutectic alloy layer surrounding a circumference of the upper tubular body, and a bottom packer extending around the upper tubular body and positioned between a bottom end of the eutectic alloy layer and the lower cone housing. The expansion cone may have a heater provided around an outer surface of a cone body.

In yet another aspect, embodiments of the present disclosure relate to methods that include running a eutectic expandable liner assembly through a well to a downhole location. The eutectic expandable liner assembly may include an expansion cone driver connected to an expansion cone and a eutectic expandable liner positioned around the expansion cone. The eutectic expandable liner may have an upper tubular body, a lower cone housing, and a eutectic alloy layer surrounding the upper tubular body, and the expansion cone may have a cone body provided in the lower cone housing and a heater provided around an outer surface of the cone body. Methods may further include activating the expansion cone driver to move the expansion cone in a direction from the lower cone housing toward the upper tubular body, activating the heater, and melting the eutectic alloy layer with the heater as the expansion cone moves through eutectic expandable liner to set the eutectic expandable liner in the downhole location.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility.

DETAILED DESCRIPTION

Figure 1:
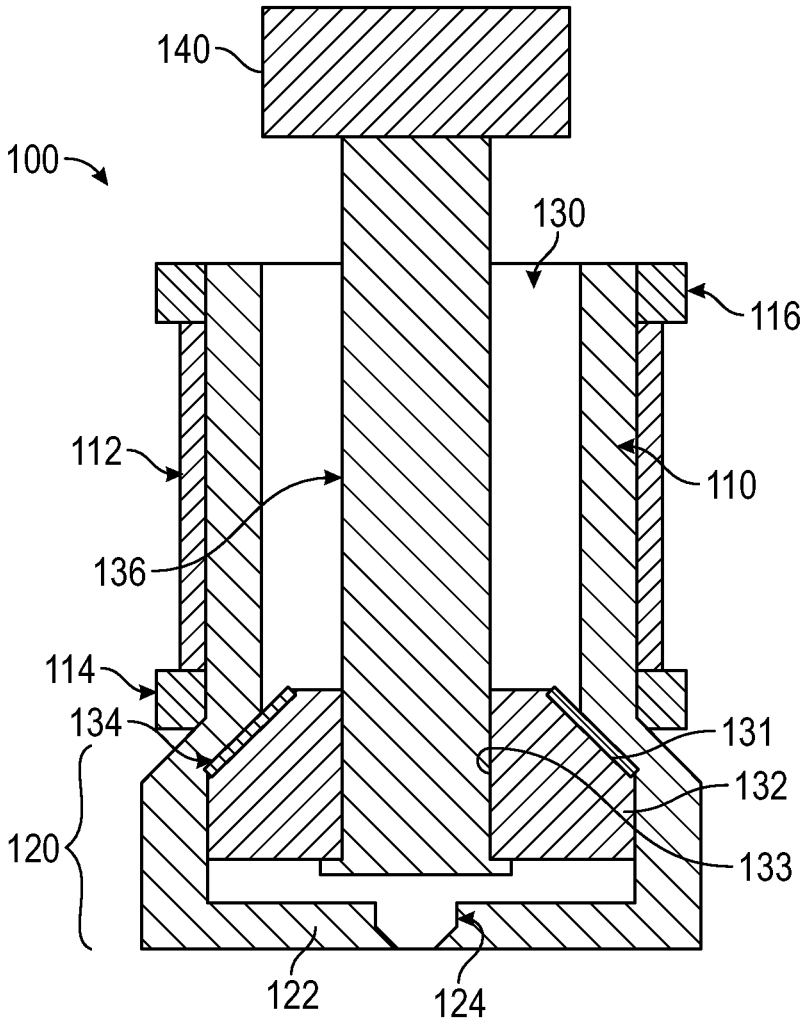
FIG. 1 is a diagram of a eutectic expandable liner and expansion assembly according to embodiments of the present disclosure.

Embodiments of the present disclosure are described below in detail with reference to the accompanying figures. In the following detailed description, numerous specific details are set forth in order to provide a more thorough understanding of the claimed subject matter. However, it will be apparent to one having ordinary skill in the art that the embodiments described may be practiced without these specific details. In other instances, well-known features have not been described in detail to avoid unnecessarily complicating the description. As used herein, the term "connected" or "connected to" may indicate establishing either a direct or indirect connection, and is not limited to either unless expressly referenced as such.

In one aspect, embodiments disclosed herein relate to apparatuses and methods for placing and setting a patch made with a eutectic alloy to seal a section of a well. The eutectic alloy patch may be set using a eutectic expandable liner, which may generally include a layer of eutectic alloy around an expandable liner, and a heating expansion assembly, which may generally include an expansion cone with a heater incorporated therein and a driver. The heating expansion assembly may be assembled to the eutectic expandable liner such that a heated expansion cone may be driven axially through the eutectic expandable liner to simultaneously heat and expand the eutectic expandable liner. Eutectic expandable liners according to embodiments of the present disclosure may be useful, for example, in sealing a section of a well having a loss zone (also sometimes referred to as a lost circulation zone), where fluid may be partially or totally lost in the hole (often referred to as lost circulation of loss-of-circulation).

Eutectic expandable liners, heating expansion assemblies, systems, and methods according to embodiments of the present disclosure are discussed in more detail below. In the below discussion, relative terms such as "lower," "upper," "bottom," and "top" may refer to the direction relative to the surface of the well when the assembly is positioned downhole.

According to embodiments of the present disclosure, a eutectic expandable liner may include an expandable liner having a generally tubular body, such as a casing pipe, made of steel, aluminum, or other ductile metal, and an outer layer made of a eutectic alloy. A eutectic alloy is a mixture of two or more components (most commonly alloys) in a ratio at which the mixture melts at a lower temperature than the melting point of any one of the individual components. Eutectic alloys will melt and solidify at the same, single temperature (rather than over a temperature range), which is sometimes referred to as the eutectic point. Examples of eutectic alloys include bismuth-based alloys, such as alloys of bismuth and tin, or alloys of bismuth and germanium and/or copper.

Eutectic expandable liners are designed to be radially expanded from having an initial minimum inner diameter to having an expanded inner diameter greater than the initial minimum inner diameter. The dimensions of the eutectic expandable liner (including its initial minimum inner diameter and wall thickness) may be chosen such that the inner diameter can be strained outwards to an expanded inner diameter where the liner can contact the well without inducing failure in the liner.

FIG. 1 shows an example of a eutectic expandable liner 100 according to embodiments of the present disclosure. The eutectic expandable liner 100 includes an upper tubular body 110 and a lower cone housing 120 having an outer diameter greater than the outer diameter of the upper tubular body. The eutectic expandable liner 100 further includes a base 122, where a circulation port 124 is formed through a central portion of the base 122. As discussed in more detail below, the circulation port 124 may be sized and shaped to receive an activation plug, which may be sent downhole to plug the circulation port 124 during operation of the eutectic expandable liner 100.

The eutectic expandable liner 100 may be made of multiple joints that are threaded together around a heating expansion assembly (e.g., an expansion cone 132 and/or expansion cone driver 136, discussed more below). For example, in one or more embodiments, the base 122 may be a separate piece from the lower cone housing 120. To assemble the system, at least a portion of a heating expansion assembly may be placed inside the lower cone housing 120, and the base 122 is then threaded to the lower cone housing 120 to enclose the bottom of the lower cone housing 122. The end of the lower cone housing 120 opposite the base 122 may then be threaded to an end of the upper tubular body 110, such that the heating expansion assembly is held inside the assembled eutectic expandable liner 100.

The upper tubular body 110 and lower cone housing 120 may be made of a ductile metal, such as steel or an aluminum alloy. In one or more embodiments, the outer diameter of the lower cone housing 120 may be selected to have a minimum clearance between the smallest restriction in the well that the eutectic expandable liner 100 is expected to travel through.

A eutectic alloy layer 112 is provided around the upper tubular body 110. In some embodiments, a eutectic alloy layer 112 may entirely surround the circumference of the upper tubular body 110. By surrounding the upper tubular body with the eutectic alloy layer, the eutectic alloy layer may be able to contact and seal a discrete circumferential section of a well without needing to rotationally align the liner with the section of the well.

The thickness of the eutectic alloy layer 112 may be designed to maintain the needed volume for sealing a section of a well, to account for expansion of the upper tubular body 110, and/or to maintain a clearance between the eutectic alloy and the well wall while the assembly is run in hole (prior to expansion). For example, a clearance between the eutectic alloy and the well wall may be in the range of greater than 0 to about 0.5 inch (e.g., between 0.2 and 0.5 inches). If the clearance is too large, too much expansion is needed beyond the capacity of the materials used. If the clearance is too small, there is risk that the assembly may get stuck while running in hole. Additionally, in one or more embodiments, the eutectic alloy layer 112 may have a thickness ranging from about 0.25 inches to several inches thick, e.g., 2 inches, 3 inches, 4 inches, or more.

The eutectic alloy layer 112 may be applied around the outer surface of the upper tubular body 110, for example, by sputtering, electroplating, or other deposition process. In some embodiments, a tubular pipe formed of eutectic alloy may be fitted concentrically around a tubular body base of an expandable alloy, where the outer eutectic tubular pipe forms the eutectic alloy layer 112. In such embodiments, the outer eutectic tubular pipe may be anchored to the tubular body base, for example, using packers or stop collars.

In the embodiment shown in FIG. 1, a bottom packer 114 extends entirely around the upper tubular body 110, positioned between a bottom end of the eutectic alloy layer 112 and the lower cone housing 120. In some embodiments, such as shown in FIG. 1, a top packer 116 is also provided around the upper tubular body 110 and is positioned at an opposite axial end of the eutectic alloy layer 112 from the bottom packer 114. In such manner, the bottom and top packers 114, 116 border the eutectic alloy layer 112. The bottom and top packers 114, 116 may be conventional rubber packers known in the art. Additionally, the bottom and top packers 114, 116 may be designed to have a thickness (as measured extending radially outward from the tubular body) capable of contacting and sealing around the well wall when the tubular body is expanded, which may thereby contain the eutectic alloy layer 112 when the eutectic alloy is heated and melted.

According to embodiments of the present disclosure, a heating expansion assembly may be assembled in a eutectic expandable liner before the assembly is run into a well. The heating expansion assembly may include an expansion cone with a heater incorporated therein and a driver for driving the expansion cone through the eutectic expandable liner. The heating expansion assembly may be assembled and positioned in the eutectic expandable liner such that the expansion cone is held at the bottom end of the liner.

For example, as shown in FIG. 1, heating expansion assembly 130 according to embodiments of the present disclosure may be assembled in the eutectic expandable liner 100. The heating expansion assembly 130 includes an expansion cone 132 having one or more heaters 134 incorporated into the expansion cone 132.

In the embodiment shown, the expansion cone 132 has an annularly shaped body with a generally conical shaped upper axial end and a heater 134 provided around an outer surface of the expansion cone body. Specifically, the heater 134 is provided on a sloped surface 131 at the upper conical end of the expansion cone 132. In some embodiments, one or more heaters may extend around an outer side surface of the expansion cone. For example, in some embodiments, heating wires may be positioned in small grooves formed around an outer sloped and/or side surface of the expansion cone. By integrating a heater at an upper conical end and/or around the outer side surface of the expansion cone, the heater may be positioned as close to the eutectic alloy layer of the liner as possible while the expansion cone is pulled through the liner, thereby allowing for more effective heating of the eutectic alloy layer.

Additionally, a central passage 133 extends axially through the expansion cone body. The central passage may provide fluid access through the expansion cone (e.g., well fluid as the assembly is sent downhole or hydraulic fluid for hydraulically activating the expansion cone) and/or electrical access to heaters incorporated in the expansion cone.

In an initial configuration, before the eutectic expandable liner 100 is expanded, the expansion cone 132 is provided in the lower cone housing 120 of the eutectic expandable liner 100. The change in diameter from the lower cone housing 120 to the upper tubular body 110 may act as a stopper to prevent the expansion cone 132 from moving through the liner when the assembly is sent downhole to a target location and before activation of the expansion cone 132. Further, in the embodiment shown, the upper sloped surface 131 at the conical end of the expansion cone may be oriented to push against a corresponding sloped surface along the change in diameter between the lower cone housing and the upper tubular body when the expansion cone 132 is activated to move through the upper tubular body.

The heating expansion assembly 130 further includes an expansion cone driver 136 connected to the expansion cone 132. When the assembly is sent downhole, the expansion cone driver 136 is connected between the expansion cone 132 and a pipe string 140 extending through the well to the surface of the well.

Expansion cone drivers may be hydraulically powered to hydraulically drive the expansion cone. For example, in some embodiments, the expansion cone driver may use hydraulic power to pressurize the area under the expansion cone, which applies a force to drive the expansion cone upward, in a direction toward the connected pipe string. In some embodiments, the expansion cone driver may be hydraulically powered by converting downhole hydraulic power into mechanical energy using a hydraulic powered motor, such as a progressive cavity positive displacement pump (sometimes referred to as a mud motor in the drilling industry). In such embodiments, a hydraulic powered motor may be connected to the expansion cone driver, between the expansion cone driver and the pipe string.

Figure 6:
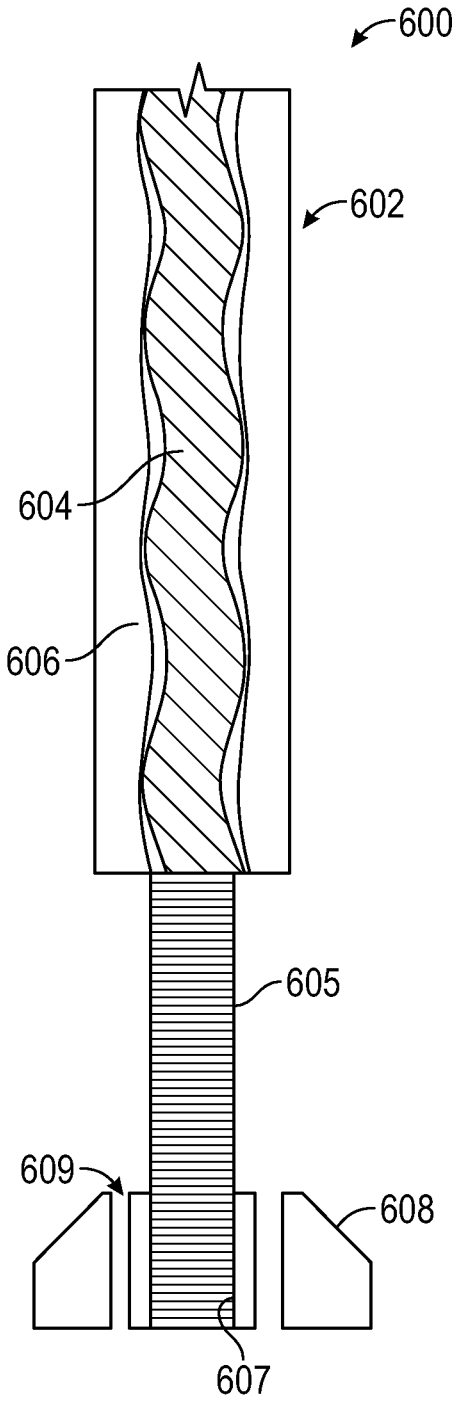
FIG. 6 shows an example of an expansion cone driver connected to an expansion cone according to embodiments of the present disclosure.

For example, FIG. 6 shows an example of a heating expansion assembly 600 according to embodiments of the present disclosure where a progressive cavity positive displacement pump is used as the expansion cone driver 602. However, other types of downhole driving equipment (e.g., hydraulically or electrically powered motors) may be used to move an expansion cone through the liner. In the embodiment shown, the expansion cone driver 602 has a helically shaped rotor 604 that rotates within a stator 606 as fluid flows through the volume between the rotor 604 and stator 606, converting hydraulic power to mechanical rotation. The rotor 604 is connected to a threaded shaft 605 that is threaded to the central passage 607 of the expansion cone 608. When fluid is flowed through the expansion cone driver 602 to rotate the rotor 604, the connected threaded shaft 605 also rotates through the expansion cone 608. The expansion cone 608 may have passages 609 formed axially therethrough to allow for fluid flow from operating the expansion cone driver 602 to pass through the expansion cone 608. During operation of the expansion cone driver 602, contact between the sloped surface of the expansion cone 608 and an inner surface of an expandable liner may prevent the expansion cone 132 from rotating with the threaded shaft 605, and instead cause the expansion cone 608 to be threaded up the threaded shaft 605. Alternatively, grooves may be provided in the outer surface of the expansion cone 608 or in an inner surface of an expandable liner, and corresponding, interlocking bridges may be provided on the other of the expansion cone outer surface or liner inner surface. The interlocking grooves/bridges may be formed linearly along the interfacing surfaces of the expansion cone and expandable liner to prevent the rotation of the expansion cone 608 with the respect to the expandable liner. In such manner, the expansion cone driver 602 may drive the expansion cone 608 upward through an expandable liner.

In one or more embodiments, electrical connectivity from the surface to a heater in the expansion cone may be provided through the expandable liner. For example, in embodiments such as shown in FIG. 6, where an expansion cone 608 is driven through an expandable liner using a progressive cavity positive displacement pump as the expansion cone driver 602, an electrical connection (e.g., including one or more wires) may be provided along the expandable liner in a configuration to electrically communicate with a heater in the expansion cone 608.

According to embodiments of the present disclosure, a eutectic expandable liner and heating expansion assembly may be sent downhole to seal a section of a well by activating the heating expansion assembly to heat and expand the eutectic expandable liner in a single run. Examples of methods and systems for sealing a section of a well using a eutectic expandable liner and heating expansion assembly according to embodiments of the present disclosure are shown and discussed with respect to FIGS. 2-5 below.

Figure 2:
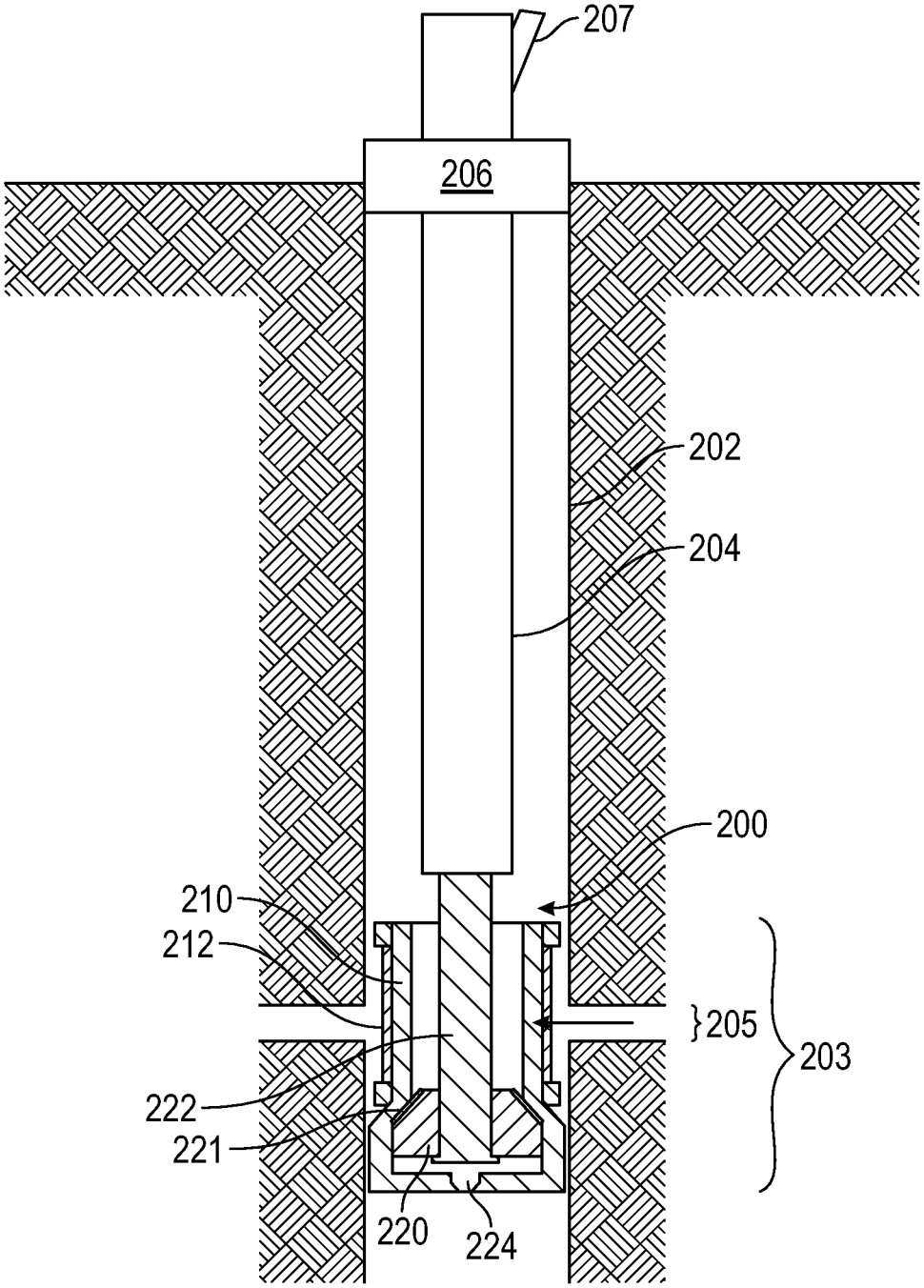
FIG. 2 is a diagram of a well system including a eutectic expandable liner and expansion assembly according to embodiments of the present disclosure.

Referring first to FIG. 2, a eutectic expandable liner and heating expansion assembly 200 may be sent through a well 202 to a downhole location 203 on a pipe string 204 (e.g., a string of drill pipe or coiled tubing). During run-in, the pipe string 204 extends through the well 202 from wellhead equipment 206 located at an opening to the well. Other known supporting equipment (not shown) may be located at the surface of the well to run-in the pipe string and connected well equipment and to operate the scaling operation.

The eutectic expandable liner and heating expansion assembly 200 is positioned at the end of the pipe string 204 and includes a eutectic expandable liner 210 assembled with a heating expansion assembly. The eutectic expandable liner 210 includes a eutectic alloy layer 212 layered around the outer circumference of a tubular body of the liner, such that the eutectic alloy forms the liner's outer surface along an axial length of the liner, and packers fitted around the liner at the opposite axial ends of the eutectic alloy layer 212. The axial length of the eutectic alloy layer 212 (and length of the liner) may be selected, for example, depending on the size of the well and the length of the well needing to be sealed. At the downhole location 203, the assembly 200 may be positioned such that the eutectic alloy layer 212 extends across the length of the well needing to be sealed.

The heating expansion assembly includes an expansion cone 220 having at least one heater 221 provided around an outer surface of the cone body and an expansion cone driver 222 connected to the expansion cone 220. In the embodiment shown, the expansion cone 220 is connected at an axial end of the expansion cone driver 222, and an opposite axial end of the expansion cone driver 222 is connected to the end of the pipe string 204, e.g., via a threaded connection. The eutectic expandable liner 210 may hang on the expansion cone 220 as the assembly is sent downhole.

The eutectic alloy layer 212 portion of the eutectic expandable liner 210 may be positioned axially above the expansion cone 220 as the assembly is sent downhole. For example, the expansion cone 220 may be provided in a lower cone housing portion of the eutectic expandable liner, where the expansion cone and the lower cone housing portion have outer diameters greater than the eutectic alloy layer 212 portion of the eutectic expandable liner 210, which may prevent the expansion cone from moving through eutectic alloy layer 212 portion of the eutectic expandable liner 210 as the assembly is sent downhole.

To allow the assembly to be sent downhole without getting stuck, a maximum outer diameter of the assembly 200 prior to expansion (e.g., measured at the outer diameter of the lower cone housing portion of the liner) may range, for example, between ⅛ and ¼ inches under-gauge (smaller in diameter) than a wellbore inner diameter at the downhole location 203. In some embodiments, an under-reaming operation may be performed prior to sending the eutectic expandable liner and heating expansion assembly downhole in order to enlarge the hole diameter so that prior to expansion the assembly fits in the open hole, and when the liner is expanded, the liner has an inner diameter equal to or smaller than the open hole inner diameter. In such embodiments, the bottom hole assembly (e.g., including a drill bit and/or reamers) is pulled out of the well prior to sending the eutectic expandable liner and heating expansion assembly into the well.

When the eutectic expandable liner and heating expansion assembly 200 is positioned at the downhole location 203, such that the eutectic alloy layer 112 extends across the section of the well needing to be sealed, the pipe string 204 is set at the surface of the well using surface equipment, such as slips on a rotary table (not shown). As shown in FIG. 2, a side-entry sub 207 is then connected to an upper end of the pipe string 204. The side-entry sub may provide downhole access to the heating expansion assembly, as described more below.

After a eutectic expandable liner and heating expansion assembly is sent to a selected downhole location, the heater(s) on the expansion cone may be electrically activated and the expansion cone may be hydraulically activated to move axially through the eutectic expandable liner. The order in which an electrical connection is provided to the heater(s) and hydraulic power is provided may depend on the type of expansion cone driver used in the eutectic expandable liner and heating expansion assembly.

For example, in embodiments using a hydraulic motor as the expansion cone driver, a wireline may be run through the pipe string (e.g., via a side-entry sub) to provide an electrical connection to the assembly and then the hydraulic motor may be activated to drive the expansion cone while the heaters on the expansion cone are electrically powered.

In some embodiments, a turbine provided downhole in the pipe string may be used to convert hydraulic power (from fluid flowing through the pipe string, e.g., drilling fluid) into electricity, which may be used to provide electricity to the heater(s) of the expansion cone. The turbine may be provided as part of a downhole electric power generator. For example, a downhole electric power generator may include a fluid inlet (e.g., in fluid communication with the flow path through the pipe string to receive fluid being pumped therethrough or in fluid communication with the well annulus to receive fluid flowing through the well), a turbine in fluid communication with the fluid inlet, an electrical generator, and one or more optional transmission components between the turbine and electrical generator. Fluid flowing through the inlet to the turbine may rotate the turbine, where the electrical generator may convert the rotational energy generated from the turbine to electrical energy. The generated electrical energy may be transmitted to heater(s) of an expansion cone via one or more electrical cables and connections. In embodiments using a downhole electric power generator to electrically power heater(s) on an expansion cone, a wireline may not need to be run through the well (and thus a side-entry sub may not need to be connected to the pipe string).

In some embodiments, such as shown in FIGS. 2-5, an expansion cone driver 222 is a fluid conduit that provides fluid from above the eutectic expandable liner 210 (e.g., from the surface of the well) to an enclosed volume below the expansion cone 220 to increase pressure below the expansion cone 220. In such embodiments, the increased pressure below the expansion cone 220 is used to drive the expansion cone upwardly through the eutectic alloy layer 212 portion of the liner. As shown, the expansion cone driver 222 extends an axial length greater than the eutectic alloy layer 212 portion of the liner and has an outer diameter that fits through a central passage extending axially through the expansion cone 220. In some embodiments, the expansion cone driver 222 may include a stopper that prevents the expansion cone 220 from sliding off the conduit.

While the expansion cone 220 shown in FIGS. 2-5 has a generally toroidal shape to allow fluid flow through its central passage, in other embodiments, an expansion cone may have a different shape, depending in part on the type of driving mechanism used to move the expansion cone axially upward through the eutectic expandable liner.

Figure 3:
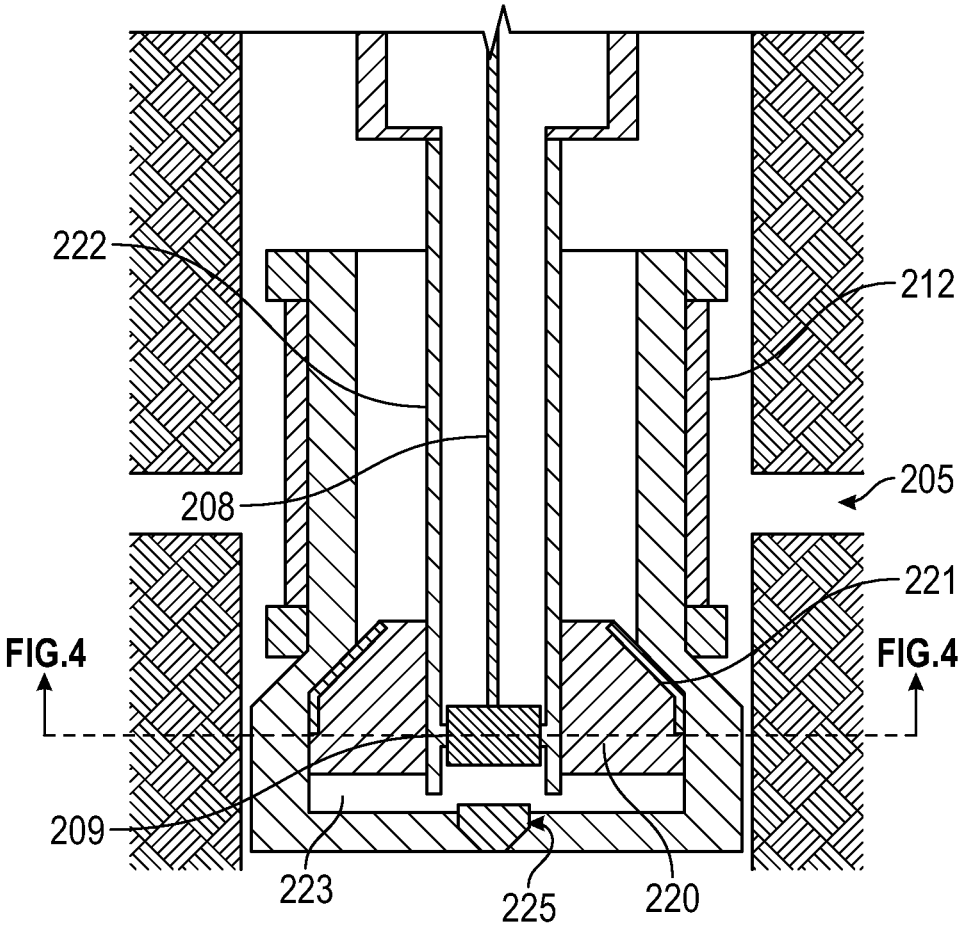
FIG. 3 is a cross-sectional view taken along an axial plane through the eutectic expandable liner and expansion assembly shown in FIG. 2.

In the embodiment shown in FIGS. 2-5, an enclosed volume 223 below the expansion cone 220 is formed, in part, by the lower cone housing portion of the liner assembly when the expansion cone 220 is held in an initial configuration prior to activation. For example, FIG. 2 shows the eutectic expandable liner and heating expansion assembly 200 in an initial configuration, where the expansion cone 220 is held in a lower cone housing portion of the eutectic expandable liner 210. A circulation port 224 is formed through a base of the lower cone housing, where the circulation port 224 may allow circulation of fluid through the pipe string and well as the assembly is being sent downhole to a downhole location 203. As shown in FIG. 3, when the assembly is positioned at the selected downhole location 203, an activation plug 225 is dropped to land on and seal the circulation port 224. In one or more embodiments, the activation plug 225 may be sized to fit through a hole formed through a wireline connection seat 226 provided in the eutectic expandable liner and heating expansion assembly 200 (described more below). In such embodiments, the activation plug 225 may be dropped from the surface through the pipe string 204 used to deliver the assembly 200 downhole and through the connection seat 226 provided in the assembly 200 to land on and seal the circulation port 224. With the activation plug 225 in sealing engagement with the circulation port 224, a fully enclosed volume 223 (with a single fluid access via the expansion cone driver 222) is formed below the expansion cone 220, between the lower cone housing and a bottom surface of the expansion cone.

Figure 4:
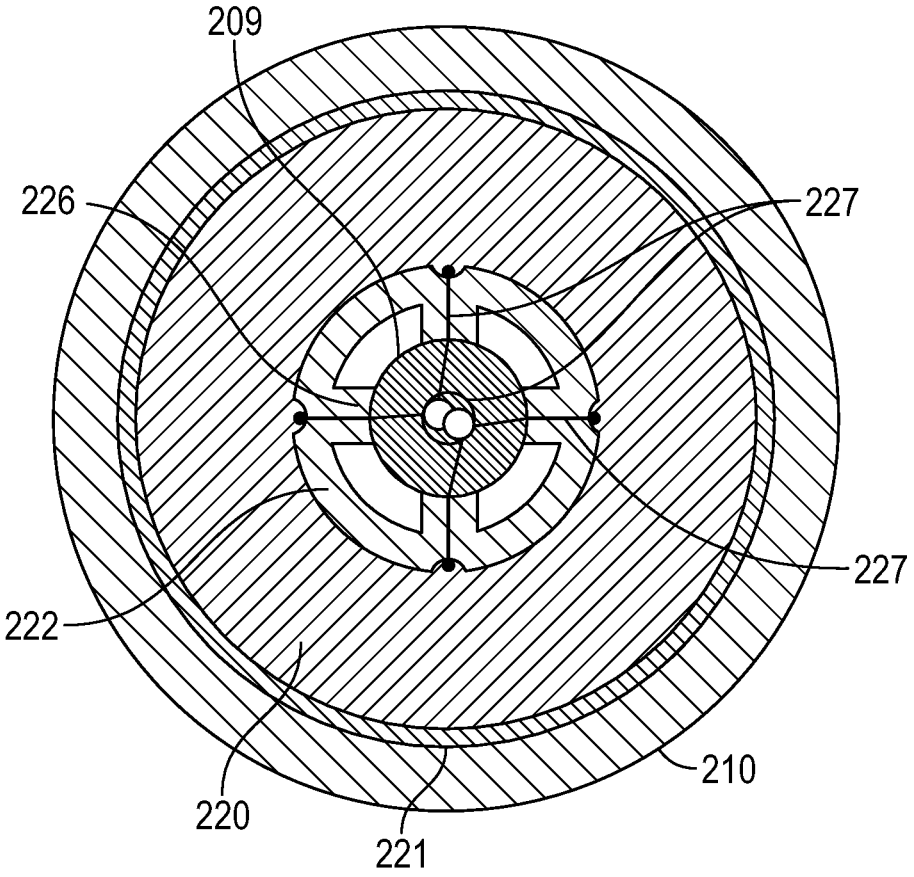
FIG. 4 is a cross-sectional view taken along a radial plane through the eutectic expandable liner and expansion assembly shown in FIG. 3.

After the activation plug 225 is in place, a wireline 208 is run from the surface, through the side-entry sub 207, to the eutectic expandable liner and heating expansion assembly 200 to provide power to the assembly. FIGS. 3 and 4 show an example of an electrical connection that may be formed using a wireline to provide power to the eutectic expandable liner and heating expansion assembly 200, where FIG. 3 shows a cross-sectional side view of the connection and FIG. 4 shows a traverse cross-sectional view of the connection. As shown, the wireline 208 includes a wireline plug 209 provided at its end. The wireline plug 209 may have a size and shape that corresponds with a connection seat 226 provided in the eutectic expandable liner and heating expansion assembly 200. For example, as described above, the connection seat 226 may have a hole formed therethrough that allows passage of the activation plug 225 through the connection seat 226, where an upper end of the hole is sized and shaped to receive and hold the wireline plug 209. In one or more embodiments, the wireline plug 209 and upper end of the connection seat hole may have corresponding and mating tapered surfaces, where the wireline plug 209 fits into the upper end of the connection seat hole but is sized to where the wireline plug 209 does not pass through the connection seat hole.

According to embodiments of the present disclosure, a connection seat may be positioned centrally in the expansion cone and electrically connected to the expansion cone heater. In the embodiment shown, the connection seat 226 is provided inside the expansion cone driver 222 at an axially shared position with the expansion cone 220. Electrical lines 227 run through the connection seat 226 to the expansion cone 220 to power the heater 221 on the expansion cone. Additionally, the wireline plug 209 may include electrically conducting outer surfaces, which may act as electrical connection points when contacted to corresponding electrical connection points in the connection seat 226.

According to embodiments of the present disclosure, the wireline plug 209 may be sent downhole via wireline 208 until the wireline plug 209 lands on the connection seat 226. Various types of guides (e.g., passages, sensors, magnets, or others) may be used to guide the wireline plug 209 to connect to the connection seat 226. Once the wireline 208 is electrically connected to the expansion cone heater 221 via the wireline plug 209 and connection seat 226, an operator may turn on and off the heater 221 according to a heating schedule for the sealing operation.

Figure 5:
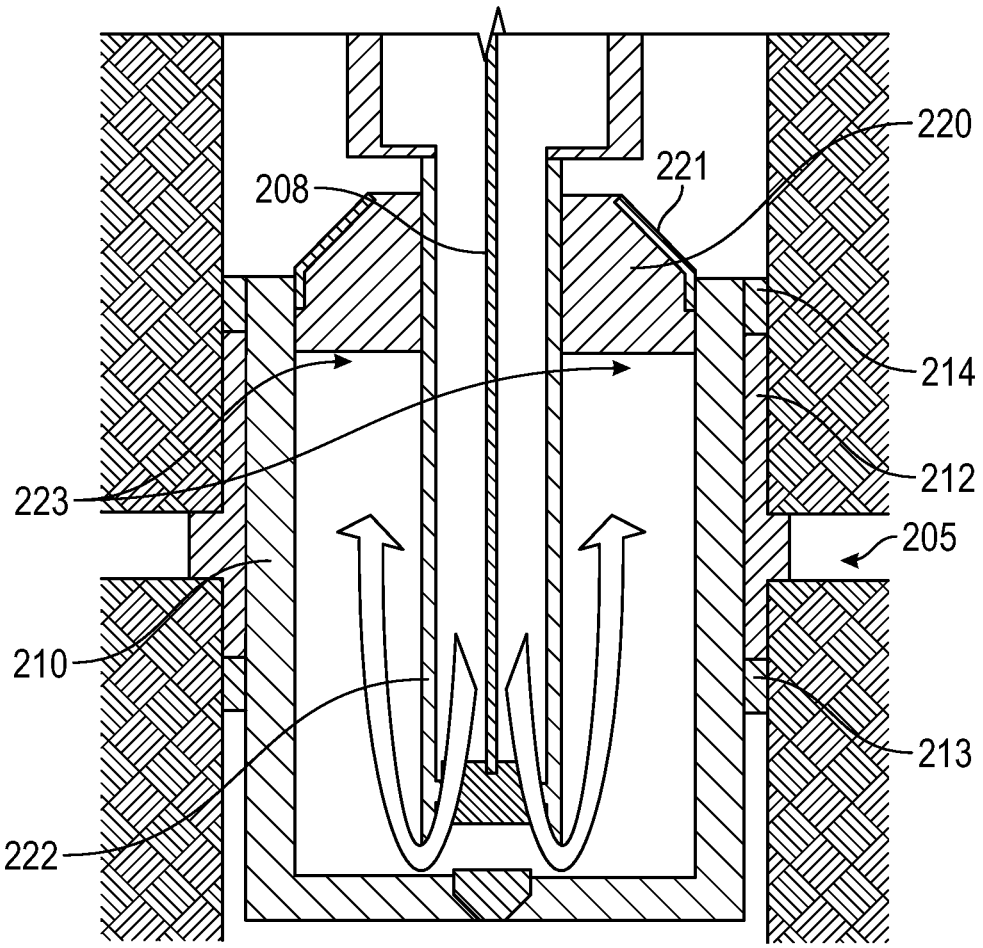
FIG. 5 shows the eutectic expandable liner and expansion assembly of FIGS. 2-4 after expansion and heating of the eutectic expandable liner.

Referring now to FIG. 5, with the circulation port 224 closed and the expansion cone heater 221 electrically connected to a power source (via the wireline), the expansion cone driver is activated to move the expansion cone in a direction from the lower cone housing toward the bottom packer. In the embodiment shown, the expansion cone driver 222 is activated by pumping fluid through the expansion cone driver, e.g., by connecting a top drive system to the side-entry sub 207 and pumping fluid through the side-entry sub into the pipe string 204 and through the connected expansion cone driver 222. As fluid is pumped through the expansion cone driver 222, the fluid fills and pressurizes the enclosed volume 223 below the expansion cone 220. The pressurized enclosed volume 223 below the expansion cone 220 moves the expansion cone 220 upward (in a direction toward the surface of the well) through the eutectic expandable liner 210. As the expansion cone 220 is moved upward through the eutectic expandable liner 210, the expansion cone 220 pushes the wall of the eutectic expandable liner 210 radially outward, thereby deforming the liner wall to have an inner diameter approximately as large as the outer diameter of the expansion cone 220. When the expansion cone 220 reaches an axial position along the eutectic expandable liner 210 having a bottom packer 213, the expansion of the liner wall pushes the surrounding bottom packer 213 radially outward to contact and seal against the well wall, thereby setting the bottom packer 213. After the bottom packer 213 is set, the heater 221 is activated (e.g., via electrical power provided through the wireline).

When the heater 221 is turned on, outer surfaces of the expansion cone 220 heated by the heater 221 heat the adjacent liner wall as the expansion cone pushes/expands the liner wall radially outward. In one or more embodiments, conductors may be incorporated through the expansion cone driver 222, where the conductors are positioned along the expansion cone driver 222 to maintain electrical connectivity between the wireline plug 209 and the expansion cone heater 221. In such manner, when the heater 221 is turned on and the expansion cone 220 is moved through the liner 210, the heating expansion cone 220 both heats the liner wall and expands the liner wall radially outward in a single pass through the liner.

The heater 221 may be turned on after passing through a bottom packer 213 to avoid heating and damaging the bottom packer 213. After passing through the section of the liner having the bottom packer 213, the heater 221 may be turned on to heat the liner wall as the expansion cone passes through the eutectic alloy layer 212 section of the liner 210. As the heating expansion cone 220 moves through the eutectic alloy layer 212 section of the liner 210, the eutectic alloy layer 212 is heated from heat transfer through the liner wall from the heater 221. Accordingly, heater(s) incorporated into the expansion cone 220 may be positioned along the expansion cone around or proximate to outer surfaces designed to contact the inner surface of the liner wall in order to improve heat transfer through the liner wall to the eutectic alloy layer 212.

The heating may be controlled so as to heat the liner wall high enough to melt the surrounding eutectic alloy layer 212. For example, in some embodiments, the expansion cone 220 (and incorporated heater 221) may be pulled through the liner 210 at a calculated rate that allows sufficient heat to be transferred through the liner wall to melt the surrounding eutectic alloy layer 212. In some embodiments, the amount of heat generated by heater(s) on an expansion cone may be controlled by turning on a selected number heaters around the expansion cone and/or by controlling the amount of heat output by a heater on the expansion cone. On/off control of heater(s) on an expansion cone and/or heat output level of heater(s) on an expansion cone may be controlled, for example, by an operator at the surface of the well, where surface commands may be transmitted via wireline to the heating system.

As the heated expansion cone 220 is moved through the section of the liner having the eutectic alloy layer 212, the eutectic alloy layer 212 is melted by heat from the expansion cone heater 221 at the same time the expansion cone 220 is expanding the liner wall radially outward. The radially outward expansion of the liner pushes the molten eutectic alloy into the surrounding section of the well. For example, as shown in FIG. 5, after the expansion cone 220 moves through the eutectic alloy layer 212 section of the liner, melting the eutectic alloy layer 212 and pushing the liner wall radially outward, the surrounding molten eutectic alloy is pushed into the well wall to seal the surrounding section of the well. There are two factors that contribute to the eutectic alloy setting in place as it is pushed into the well wall: 1) solidification happens immediately after the molten eutectic alloy is pushed into the well wall, similar to the solidification timeframe of soldering; and 2) the volume of the eutectic alloy may be calculated to which it fills the entire needed volume around the well wall.

When the heated expansion cone 220 has completely moved through the eutectic alloy layer 212 section of the liner, the heater 221 may be turned off. In some embodiments, as shown in FIG. 5, a top packer 214 is provided around the liner on an axial side of the eutectic alloy layer 212 opposite the bottom packer 213. In such embodiments, the heated expansion cone 220 continues to move through the expandable liner 210 (with the heater 221 on) until the expansion cone 220 reaches a portion of the liner having the top packer 214, at which point the heater 221 is turned off. With the heater 221 off, the expansion cone 220 continues to move through the portion of the liner having the top packer 214, thereby expanding the top packer 214 radially outward to contact and seal against the surrounding well wall.

As shown in FIG. 5, when the expansion cone 220 has finished moving through the eutectic expandable liner 210, the expanded liner is set and the surrounding section of the well is sealed. The heating expansion assembly (including the expansion cone 220 and the connected expansion cone driver 222) may then be pulled out of the well after the expandable liner is set in the downhole location. In some embodiments, after the expandable liner is set and the pipe string with the connected heating expansion assembly is removed, subsequent well operations may be performed, such as running a bottom hole assembly through the well and through the set expandable liner to drill past the sealed downhole location.

The eutectic expandable liner and heating expansion assembly 200 may be sent downhole to seal and line a portion of a well for different reasons involving sealing fluid flow between the well and the surrounding formation. Additionally, eutectic expandable liner and heating expansion assemblies according to embodiments disclosed herein may be used to seal cased or uncased (open hole) portions of a well.

In the embodiment shown, the eutectic expandable liner and heating expansion assembly 200 is sent to a downhole location 203 in an open hole section of the well 202 having a loss zone 205. A loss zone 205 may refer to a portion of the well in which fluid being circulated through the well is partially or totally lost through the loss zone into the formation. Thus, loss of circulation may physically be seen when the flow rate in the returns line from the well drops below the flow rate in lines pumping fluid into the well. There are degrees of loss of circulation that may be identified in a well based on the difference in the flow rates of fluid into and out of the well. For example, a total loss of circulation occurs when no return fluid reaches the surface following introduction of drilling fluid into the wellbore. A partial loss of circulation occurs when a predefined minimum amount of return fluid reaches the surface following introduction of drilling fluid into the wellbore. For example, a loss zone may be identified as a portion of the well in which fluid flows from the well into the formation at a rate of at least 10 bbls/hr.

According to embodiments of the present disclosure, prior to sending the eutectic expandable liner assembly downhole, the downhole location of a loss zone may be identified within an accuracy that is shorter than half the axial length of the eutectic alloy layer 112 provided on the eutectic expandable liner 210. In some embodiments, after identifying a loss zone and prior to running the eutectic expandable liner assembly through the well, the axial length and thickness of the eutectic alloy layer 112 applied on the eutectic expandable liner 110 may be based on the predicted size of the loss zone.

Additionally, once the loss zone 205 is identified, an operator may prepare the well for a sealing operation by drilling beyond the identified loss zone 205, deep enough to give enough space for the eutectic expandable liner and heating expansion assembly 200 to be positioned next to and seal the loss zone.

When a sealing operation is performed on a section of a well having a loss zone, such as shown in FIGS. 2-5, the eutectic alloy layer 212 provided around the liner body may be designed to have sufficient size (e.g., thickness and axial length) to flow into the loss zone 205 when melted. As the molten eutectic alloy flows into the loss zone 205, away from the heated expansion cone 220, the eutectic alloy cools. Once the molten eutectic alloy cools to its eutectic temperature, the eutectic alloy resolidifies to seal the loss zone 205.

Embodiments of the present disclosure may provide at least one of the following advantages. Commercially available expandable liner patches are typically made of steel, which is too strong to deform around obstacles behind it, e.g., cuttings or wellbore irregularities. Thus, when obstacles are present behind a conventional liner, an expansion cone running through the liner may not be able to push and expand the liner, but will instead push against the formation, which will stop the progress of the cone and fail the operation. However, by using eutectic expandable liners and heating expansion assemblies according to embodiments of the present disclosure, an outer layer of soft heated eutectic alloy would expand over obstacles, if any, while expanding the inner liner. Additionally, by using eutectic expandable liners and heating expansion assemblies according to embodiments of the present disclosure, the sealing process may be completed in a single run, where the eutectic liner is expanded and heated in a single pass of the expansion cone.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A downhole tool, comprising:
an expandable liner, comprising:
an upper tubular body;
a lower cone housing, comprising:
an outer diameter greater than the upper tubular body; and
a base, wherein the base comprises a circulation port extending through the base and an activation plug in sealing engagement with the circulation port;
a eutectic alloy layer surrounding a circumference of the upper tubular body; and
a bottom packer and a top packer extending around the upper tubular body and positioned around opposite ends of the eutectic alloy layer;
an expansion cone, comprising:
a cone body provided in the lower cone housing; and
a heater provided around an outer surface of the cone body; and
an expansion cone driver connected to the expansion cone.

2. The downhole tool of claim 1, wherein the heater extends around the outer surface at an upper conical end of the cone body.

3. The downhole tool of claim 1, wherein the upper tubular body is made of a ductile metal selected from steel or aluminum.

4. The downhole tool of claim 1, further comprising a hydraulic powered motor connected to the expansion cone driver.

5. The downhole tool of claim 1, further comprising a connection seat positioned centrally in the expansion cone and electrically connected to the heater.

6. A system, comprising:
a pipe string extending through a well from wellhead equipment at an opening to the well;
an expansion cone driver connected at an end of the pipe string;
a eutectic expandable liner, comprising:
an upper tubular body;
a lower cone housing having an outer diameter greater than the upper tubular body,
wherein the lower cone housing comprises a base with a circulation port formed therethrough;
an activation plug in sealing engagement with the circulation port;
a eutectic alloy layer surrounding a circumference of the upper tubular body; and
a bottom packer extending around the upper tubular body and positioned between a bottom end of the eutectic alloy layer and the lower cone housing;
an expansion cone connected at an end of the expansion cone driver and positioned in the lower cone housing, the expansion cone comprising a heater provided around an outer surface of a cone body.

7. The system of claim 6, further comprising a wireline plug provided at an end of a wireline extending through the well, wherein the wireline plug is electrically connected to the heater via a connection seat.

8. The system of claim 7, further comprising a side-entry sub connected along the pipe string, wherein the wireline extends through the side-entry sub.

9. The system of claim 6, wherein the expansion cone driver comprises a fluid path fluidly connecting the pipe string to an area between the lower cone housing and a bottom surface of the expansion cone.

10. The system of claim 6, wherein the expansion cone driver comprises a hydraulic powered motor.

11. The system of claim 6, wherein the eutectic expandable liner is held by the pipe string at a downhole location in the well, and wherein the outer diameter of the lower cone housing ranges between ⅛ and ¼ inch smaller than a wellbore inner diameter at the downhole location.

12. The system of claim 6, wherein the bottom packer has a thickness ranging from 0.5 to 2 inches.

13. The system of claim 6, wherein the eutectic alloy layer has a thickness ranging from 0.25 to 2 inches.

14. A method, comprising:
running a eutectic expandable liner assembly through a well to a downhole location, the eutectic expandable liner assembly comprising:
a eutectic expandable liner, comprising:
an upper tubular body;
a lower cone housing having an outer diameter greater than the upper tubular body;
a eutectic alloy layer surrounding the upper tubular body;
a base, wherein the base comprises a circulation port extending through the base; and
a bottom packer extending around the upper tubular body and positioned between a bottom end of the eutectic alloy layer and the lower cone housing;
an expansion cone, comprising:
a cone body provided in the lower cone housing; and
a heater provided around an outer surface of the cone body; and
an expansion cone driver connected to the expansion cone;
activating the expansion cone driver by dropping an activation plug into the circulation port and pumping fluid through the expansion cone driver to move the expansion cone in a direction from the lower cone housing toward the bottom packer;
activating the heater; and
melting the eutectic alloy layer with the heater as the expansion cone moves through eutectic expandable liner to set the eutectic expandable liner in the downhole location.

15. The method of claim 14, wherein the downhole location comprises an open hole portion of the well having a loss zone.

16. The method of claim 15, further comprising, prior to running the eutectic expandable liner assembly through the well, selecting an axial length and a thickness of the eutectic alloy layer applied around the upper tubular body based on a predicted size of the loss zone.

17. The method of claim 14, further comprising:

continuing to move the expansion cone through the eutectic expandable liner to a portion of the upper tubular body having a top packer extending around the upper tubular body;

turning off the heater as the expansion cone moves through the portion of the upper tubular body having the top packer;

pulling the expansion cone and the expansion cone driver out of the well after the eutectic expandable liner is set in the downhole location; and running a bottom hole assembly through the well and through the set eutectic expandable liner to drill past the downhole location.

* * * * *